US009693624B2

(12) United States Patent
Mitchell et al.

(10) Patent No.: US 9,693,624 B2
(45) Date of Patent: Jul. 4, 2017

(54) CONTINUOUS FORCE SPRING ELEVATABLE WORK PLATFORM

(71) Applicant: QUEST ENG LLC, Belmont, MI (US)

(72) Inventors: Terry Mitchell, Belmont, MI (US); Richard D. Arnold, Grand Haven, MI (US); Mathew R. Ruster, Zeeland, MI (US); Greggory J. Elhart, Zeeland, MI (US)

(73) Assignee: QUEST ENG LLC, Belmont, MI (US)

( * ) Notice: Subject to any disclaimer, the term of this patent is extended or adjusted under 35 U.S.C. 154(b) by 0 days.

(21) Appl. No.: 15/173,039

(22) Filed: Jun. 3, 2016

(65) Prior Publication Data

US 2016/0353876 A1 Dec. 8, 2016

Related U.S. Application Data

(60) Provisional application No. 62/170,776, filed on Jun. 4, 2015.

(51) Int. Cl.
*A47B 5/00* (2006.01)
*A47B 9/00* (2006.01)

(52) U.S. Cl.
CPC ..... *A47B 5/00* (2013.01); *A47B 9/00* (2013.01); *A47B 2200/004* (2013.01)

(58) Field of Classification Search
CPC .... A47B 5/00; A47B 9/00; A47B 9/02; A47B 9/08; A47B 2200/004
See application file for complete search history.

(56) References Cited

U.S. PATENT DOCUMENTS

| | | | | | |
|---|---|---|---|---|---|
| 4,651,652 | A * | 3/1987 | Wyckoff | A47B 9/12 | 108/147 |
| 4,926,760 | A | 5/1990 | Sack | | |
| 4,969,403 | A * | 11/1990 | Schwartz | A47B 5/00 | 108/147 |
| 5,083,514 | A * | 1/1992 | Schwartz | A47B 5/00 | 108/108 |
| 5,373,793 | A * | 12/1994 | Crossman | A47B 9/04 | 108/42 |
| 6,062,148 | A * | 5/2000 | Hodge | A47B 9/12 | 108/147 |
| 2004/0040480 | A1 | 3/2004 | Hwang | | |
| 2015/0075086 | A1 * | 3/2015 | Gosling | A47B 96/02 | 52/29 |
| 2016/0213146 | A1 * | 7/2016 | Gosling | A47B 9/12 | |

* cited by examiner

*Primary Examiner* — Daniel Rohrhoff
(74) *Attorney, Agent, or Firm* — John S. Hale; Gipple & Hale

(57) ABSTRACT

A work platform height adjustment apparatus having a frame and a support assembly moveably mounted on the frame. The frame is provided with cover panels which are mounted to the frame and the support assembly carries a spring biased work platform on brackets mounted to the support assembly so that the work platform can assume a number of fixed height positions.

19 Claims, 10 Drawing Sheets

CONTINUOUS FORCE SPRING ELEVATABLE WORK PLATFORM

RELATED APPLICATIONS

This is a utility patent application claiming priority and benefit from U.S. Provisional Patent Application No. 62/170,776, filed Jun. 4, 2015.

STATEMENT REGARDING FEDERALLY SPONSORED RESEARCH OR DEVELOPMENT

Not applicable.

REFERENCE TO SEQUENCE LISTING, A TABLE OR A COMPUTER PROGRAM LISTING COMPACT DISC APPENDIX

None.

BACKGROUND OF THE INVENTION

1. Field of Invention

The present invention is directed to a wall mounted adjustable work platform having adjustable elevation. Such a device improves work force productivity and reduces strain associated with prolonged sitting and/or standing.

2. Description of the Prior Art

In our current computer oriented society, large numbers of people find themselves sitting at a desk or workstation for extended periods of time. This has resulted in a variety of work related injuries and loss of productivity. There have also been numerous studies conducted over the past several years that have identified serious health risks associated with prolonged sitting. These include the risks of high blood pressure, cardiovascular disease, diabetes and obesity as well as back pain and strain.

Studies have also shown that alternating between sitting and standing throughout the day helps to reduce these risks, reduces general fatigue and increases productivity.

The drawing shown in FIG. 1 shows a prior art height adjustable table currently being used. Telescoping legs provide 18" to 20" height adjustment and a horizontal member connects and synchronizes the movement of the two legs. The telescoping leg design is expensive, restricts the design appearance of the table legs, and cannot be easily reduced in size for wall or office panel attachment.

The ideal height work surface height range is 27" for a low sit-down position and 47" for stand-up position which is a 20" adjustment range. Designing a telescoping leg mechanism to meet this adjustment range is difficult and requires using every inch of space inside the telescoping tubes. Adapting this mechanical concept to panel mounted surfaces results in a telescoping leg almost 27" in height, which is why freestanding adjustable tables are used.

Typically a non-adjustable work surface in an open office work space is attached directly to the panel without support legs. This keeps the knee space under the surface open for easy user leg movement, easier floor cleaning (because there are no table legs), and a cleaner, uncluttered looking work space. The problem is that changing the work surface height requires manually removing and reinstalling the surface at a different height.

The drawings shown in FIGS. 1 and 2 shows how freestanding height adjustable tables are currently used in a typical open office work space. This is an expensive solution to the problem and violates many advantages offered by panel created office spaces.

Another adjustable work surface table presently in the marketplace is the Hack product by Vitra which uses a pulley system tied to a crank. The belts, which form the pulley system, are tightened by cranks which tighten or loosen the belts to adjust the work station platform surface up and down. The table is free standing and can be folded up into a box or flat cabinet for storage or moving.

Representative adjustable work surfaces shown in the prior art are U.S. Pat. No. 4,926,760 issued May 22, 1990 which discloses a self-leveling table having a pair of scissor arms pivotally mounted on the table. The scissor arms are restraining from closing by a set of adjustable springs and U.S. Patent Application Publication Number 2004/0040480 having a publication date of Mar. 4, 2004 which discloses a height adjustable table top using a scissoring support assembly mounted in tracks formed in the table top frames and the support frame.

The present invention overcomes these problems by providing a wall mountable adjustable height work platform which is spring assisted to allow easy adjustment.

SUMMARY OF THE INVENTION

The present invention addresses the ergonomic need to easily adjust the height of a work platform from a sit-down use position to a stand-up position to promote blood circulation and relieve user back pain. Since people are of different sizes there is a need to adjust the work surface height for the use of different people which allows multiple people to have a tailored work site. A work platform is defined as any horizontal surface that must remain level during and after the height is adjusted. The invention utilizes a frame having a moveable support assembly which carries the work platform and moves vertically on slide rods mounted to the frame. The support assembly has a plurality of continuous force springs mounted thereon which are also connected to the frame to provide a force assist to the work platform.

It is a principal object of this invention to provide a height adjustable work platform with a planar surface that will move up or down to accommodate the smallest seated individual employee and then rise up to accommodate the tallest standing individual employee.

It is another object of the invention that the height adjustment of the work surface platform is assisted by a spring assembly.

It is yet another object of the invention to provide a height adjustable wall mounted work platform assembly which can be easily attached to a wall or room panel or mounted inside a wall or room panel.

It is still another object of the invention to provide a simply constructed work platform with a height adjustable work surface.

It is another object of this invention that the work platform is user controlled and manually operated so that the work platform adjusts quickly to various up and down heights without the use of expensive electric motors or cumbersome manual cranks. However, an electric motor can easily be installed to make the platform move up and down.

It is a still further object of this invention that the spring assist can be variably located to counterbalance different platform weights.

It is another feature of this invention that the work platform provides maximum legroom underneath for seated positions and requires minimum use of office space in the standing position.

These and other objects, advantages, and novel features of the present invention will become apparent when considered with the teachings contained in the detailed disclosure along with the accompanying drawings.

BRIEF DESCRIPTION OF THE DRAWINGS

The present invention will be described with reference to the appended Figures, in which.

DESCRIPTION OF THE INVENTION

The present invention is directed towards a height adjustable work platform apparatus and the preferred embodiment and best mode of the invention is shown in FIGS. 3 through 9.

Figure 4:
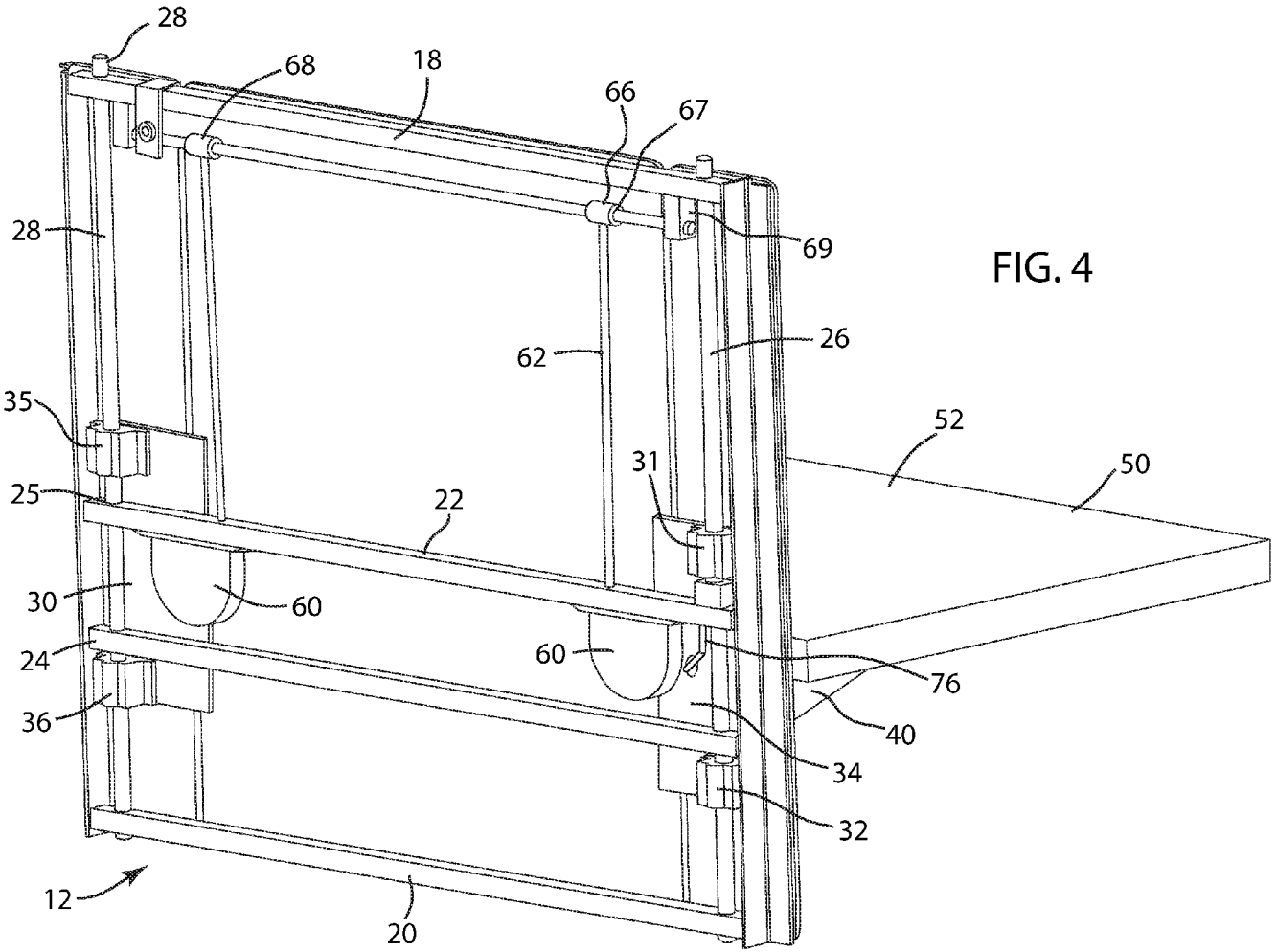
FIG. 4 is a rear perspective view of the height adjustable work platform of FIG. 3.
Figure 5:
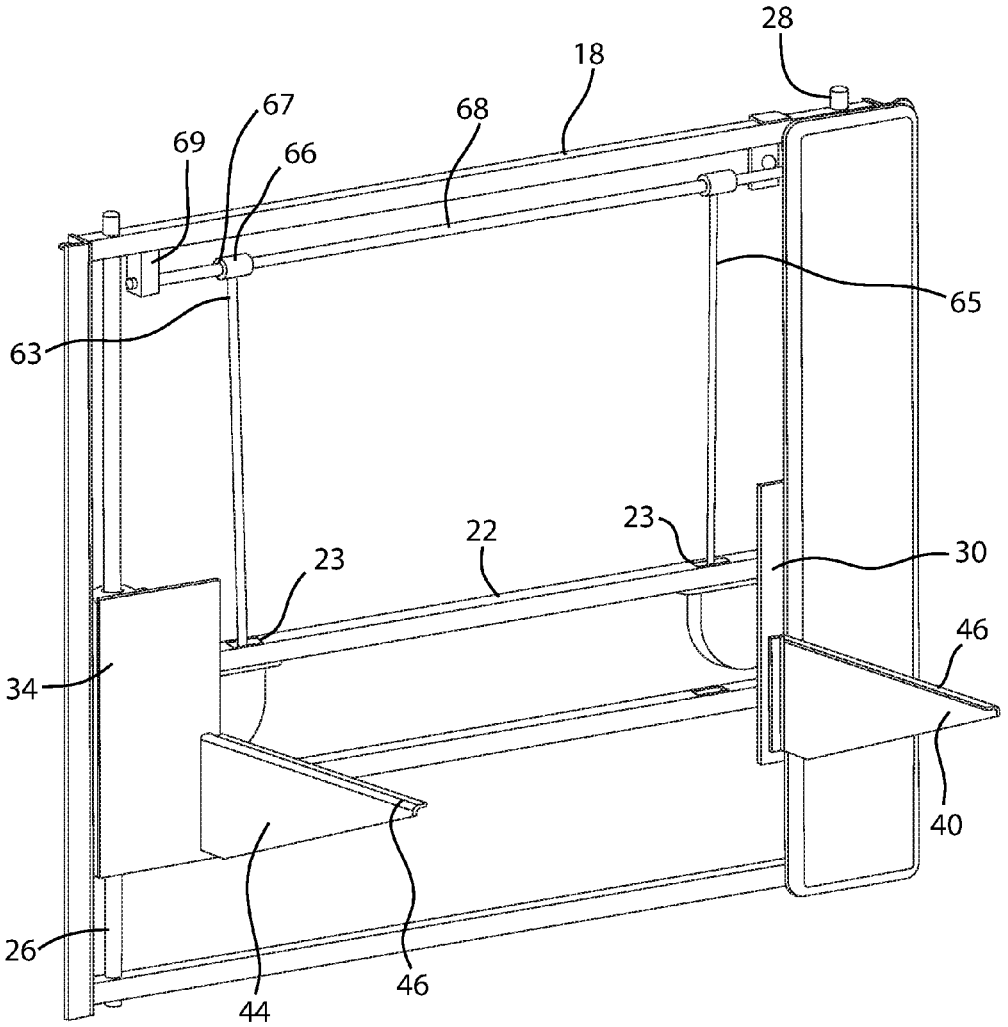
FIG. 5 is a perspective view of the height adjustable work platform shown in FIG. 3 with the work platform, one side panel and middle panel removed.
Figure 6:
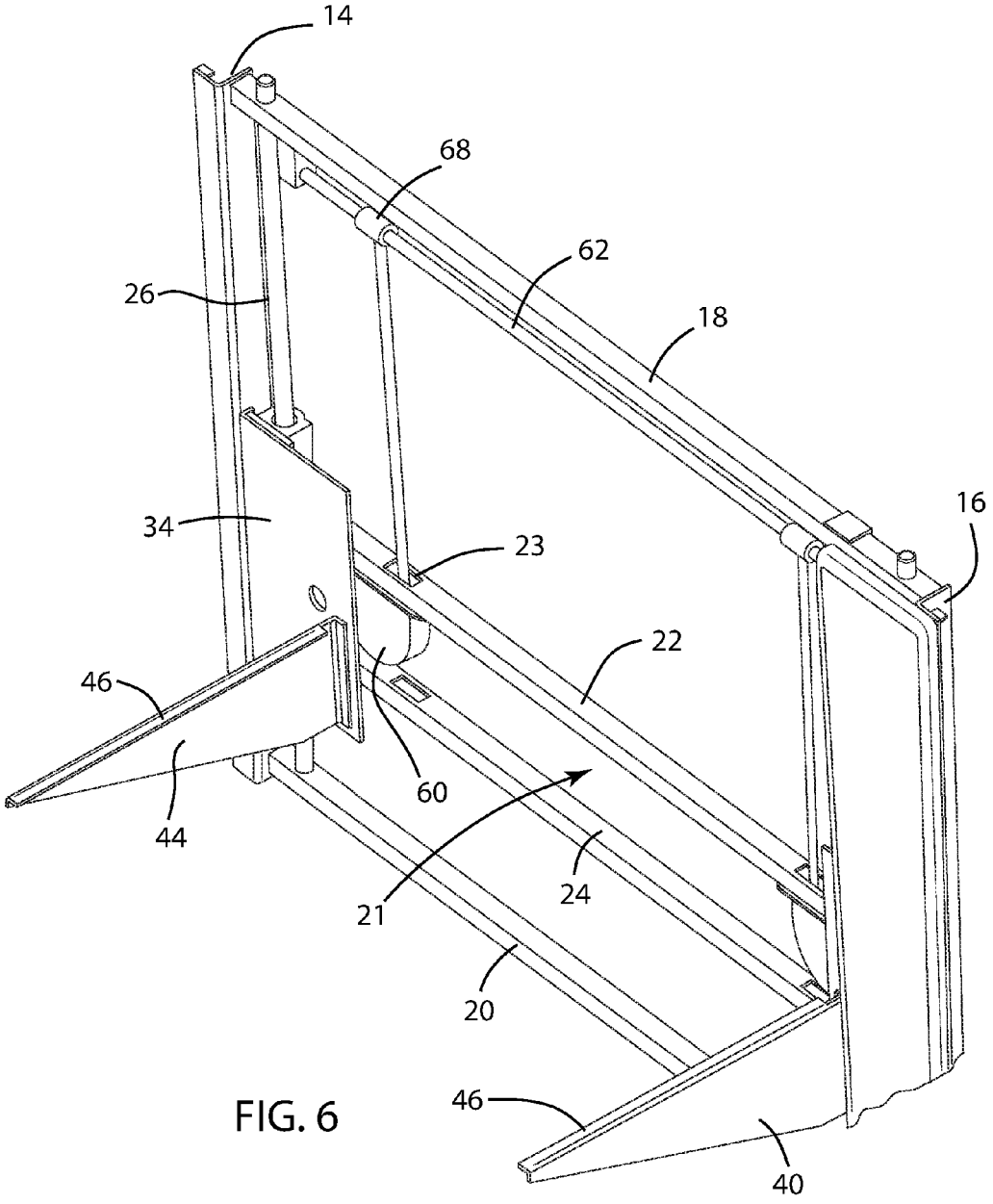
FIG. 6 is an opposite side perspective view of the height adjustable work platform shown in FIG. 5.
Figure 7:
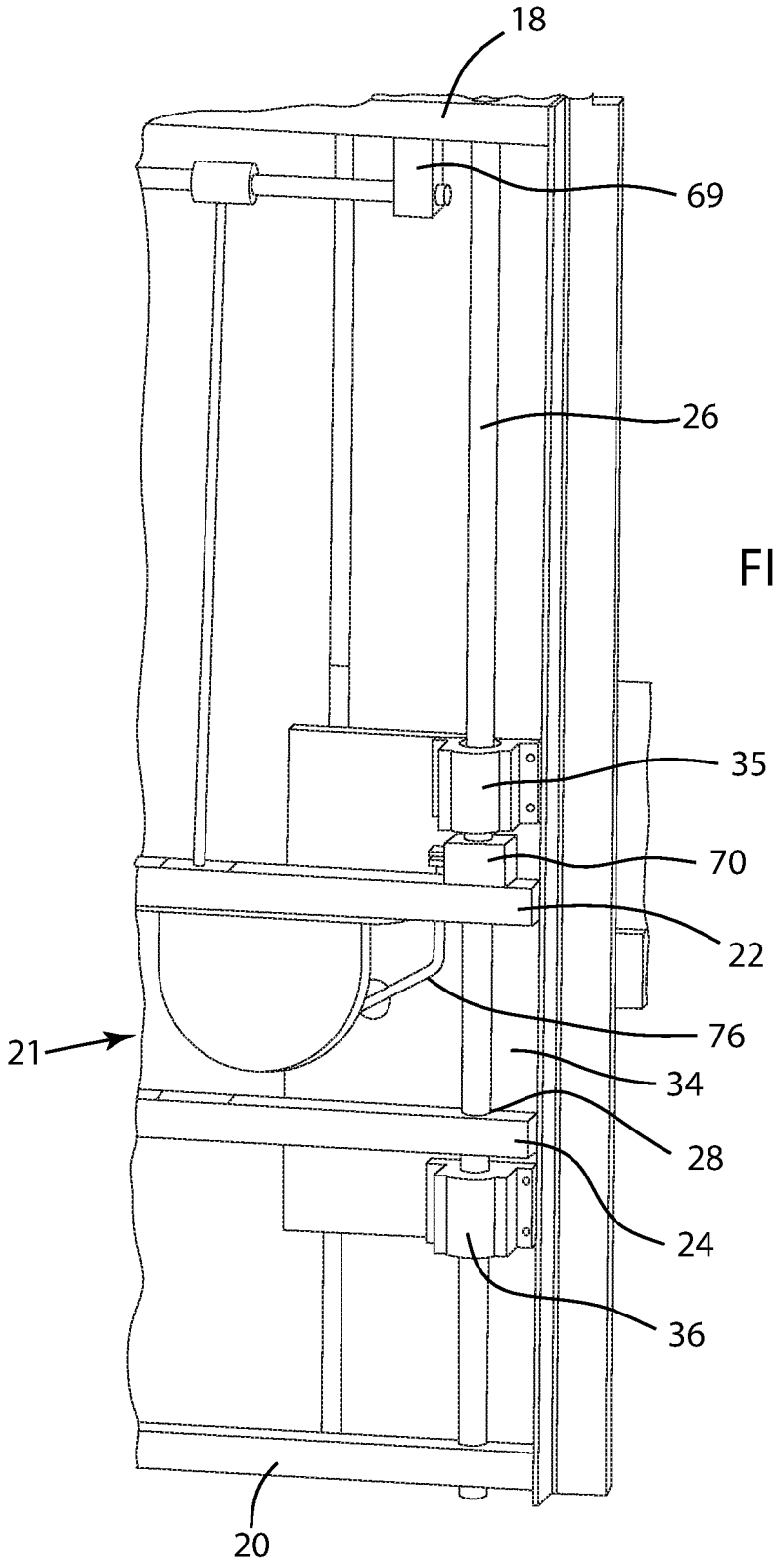
FIG. 7 is a partial enlarged rear view of the height adjustable work platform shown in FIG. 4.

FIGS. 4 through 9 disclose a frame 12 of the adjustable work platform apparatus with two parallel upright L-shaped standards 14 and 16. As shown in FIG. 6, an upper cross member 18 is secured to the top of standards 14 and 16 and a lower bottom cross member 20 is secured to the bottom of the upright standards 14 and 16. The standards and cross members can be welded together, glued or fastened together with conventional fasteners. This frame 12 can be installed on an office panel (see FIG. 11), on a wall (see FIG. 10) or it can be independent to hang on the outside of an office panel by various means (hooks on frame, hang over the top of a panel; attached to a wall).

A moveable work platform support assembly 21 has two middle parallel cross support members 22 and 24 which extend between the upright standards 14 and 16 and are slidably mounted on slide rods 26 and 28. Slide rods 26 and 28 are mounted in throughgoing holes 25 cut in cross members 22 and 24 and the slide rods are secured to the upper cross member 18 and the lower cross member 20. Support plates 30 and 34 are fixedly secured to cross members 22 and 24 by welding, fasteners or other means to hold the cross members 22 and 24 in a fixed position and hold work platform brackets. Each support plate is provided with a pair of aligned linear bearing assemblies secured thereto (31, 32), (35, 36). The linear bearings assemblies 31, 32 and 35, 36 are securely mounted to the respective support plate as shown in FIG. 4. Slide rod 26 is slidably mounted in linear bearings assemblies 31, 32 and slide rod 28 is slidably mounted in linear bearings assemblies 35, 36, allowing the cross support members 22 and 24 and the support plates 30 and 34 to slide up and down slide rods 26 and 28. Extending outwards perpendicularly from each of the support plates 30 and 34 are work platform brackets 40 and 44, respectively. The platform brackets are secured to the support plates by welding if metal or integrally molded if plastic. Alternatively, they may be mounted in slots cut into the support plates or secured by fasteners to the support plates. Each of the work platform brackets 40 and 44 has a planar top surface 46 upon which the work platform 50 is seated as shown in FIGS. 3 and 6.

Figure 1:
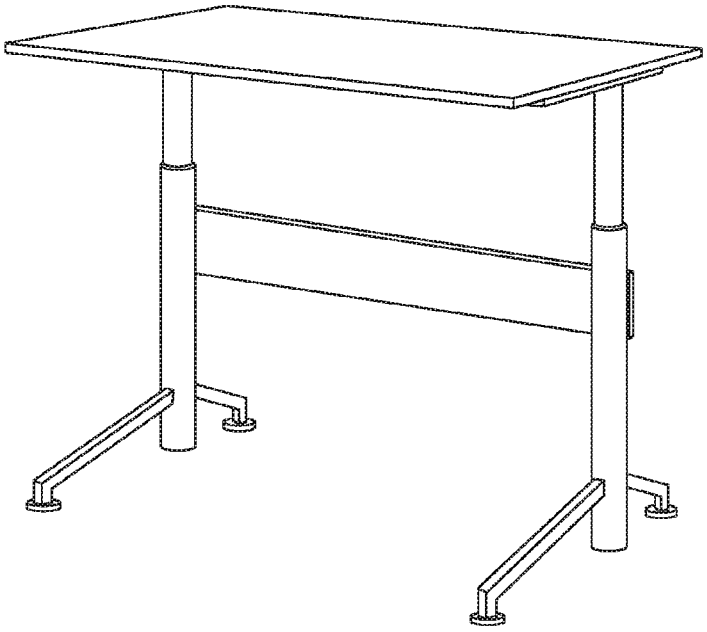
FIG. 1 PRIOR ART
FIG. 1 is a perspective view of an elevatable prior art telescoping table.
Figure 2:
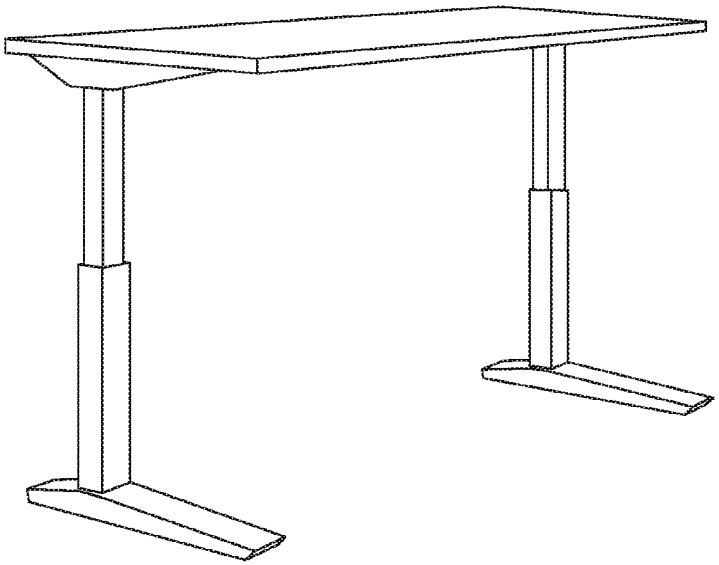
FIG. 2 PRIOR ART
FIG. 2 is another perspective view of an elevatable prior art telescoping table.
Figure 3:
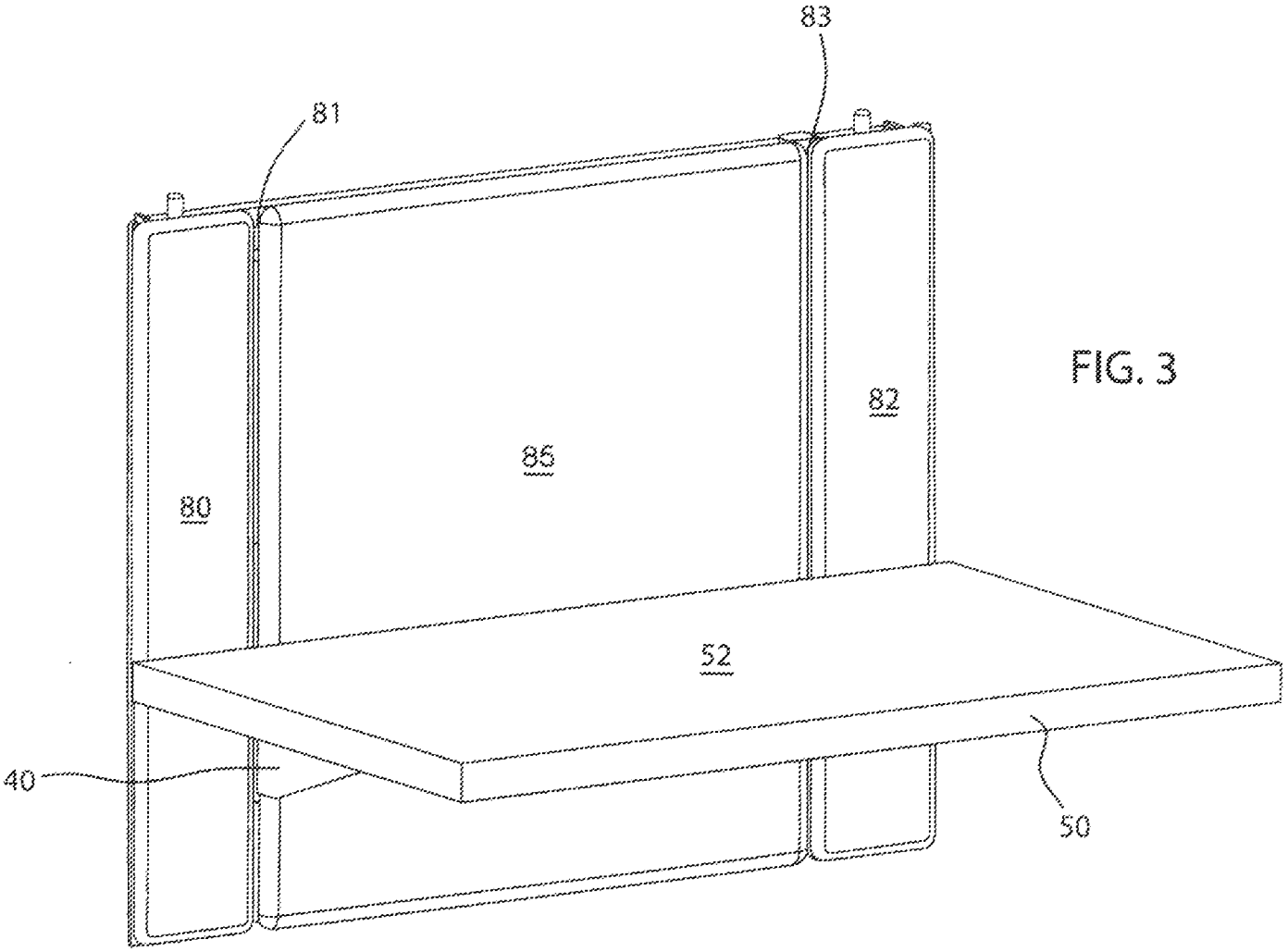
FIG. 3 is a front perspective view of the inventive continuous force spring height adjustable work platform with a panel background.

As seen in FIG. 3, two side panels 80 and 82 are mounted on the front of the frame 12 on the side of work platform brackets 40 and 44. A middle panel 85 is mounted adjacent the interior surface of work platform brackets 40 and 44 defining a vertical gap 81 and 83 which allow the work platform brackets 40 and 44 to move along and through when the work platform 50 is moved upward or downward. Thus, the work platform 50 is held in placed by each of the continuous force spring assemblies which form a spring assistance for lowering and raising the work platform 50.

Figure 9:
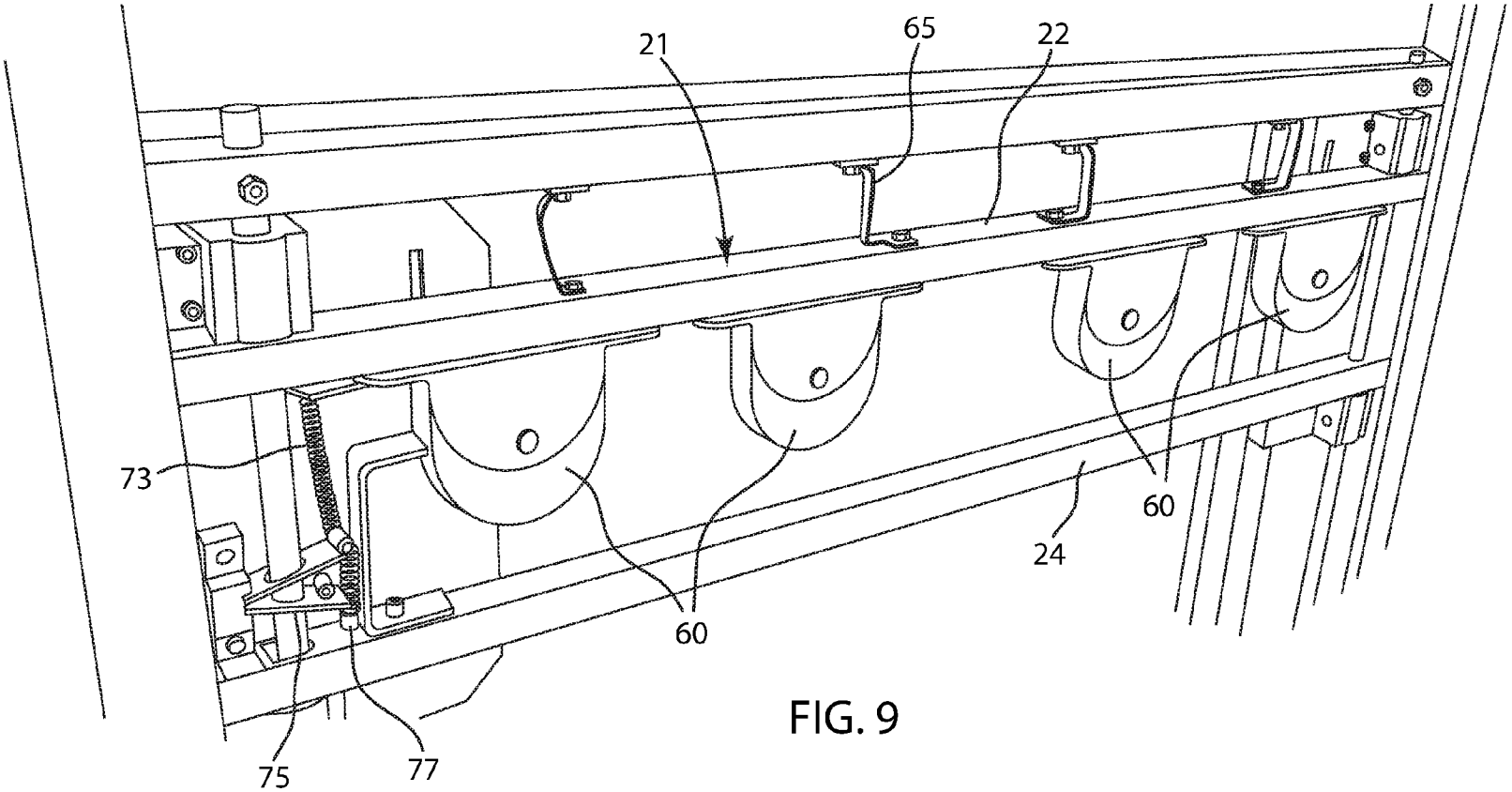
FIG. 9 is an enlarged partial view of another embodiment showing additional continuous force spring assemblies connected directly to upper cross member of the apparatus frame.
Figure 10:
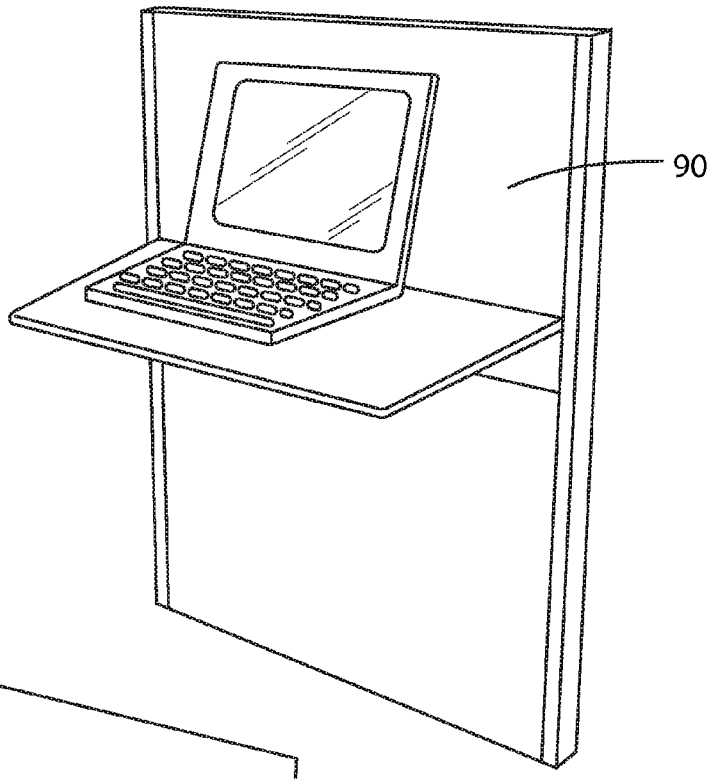
FIG. 10 is a perspective view of the invention mounted on a wall.
Figure 12:
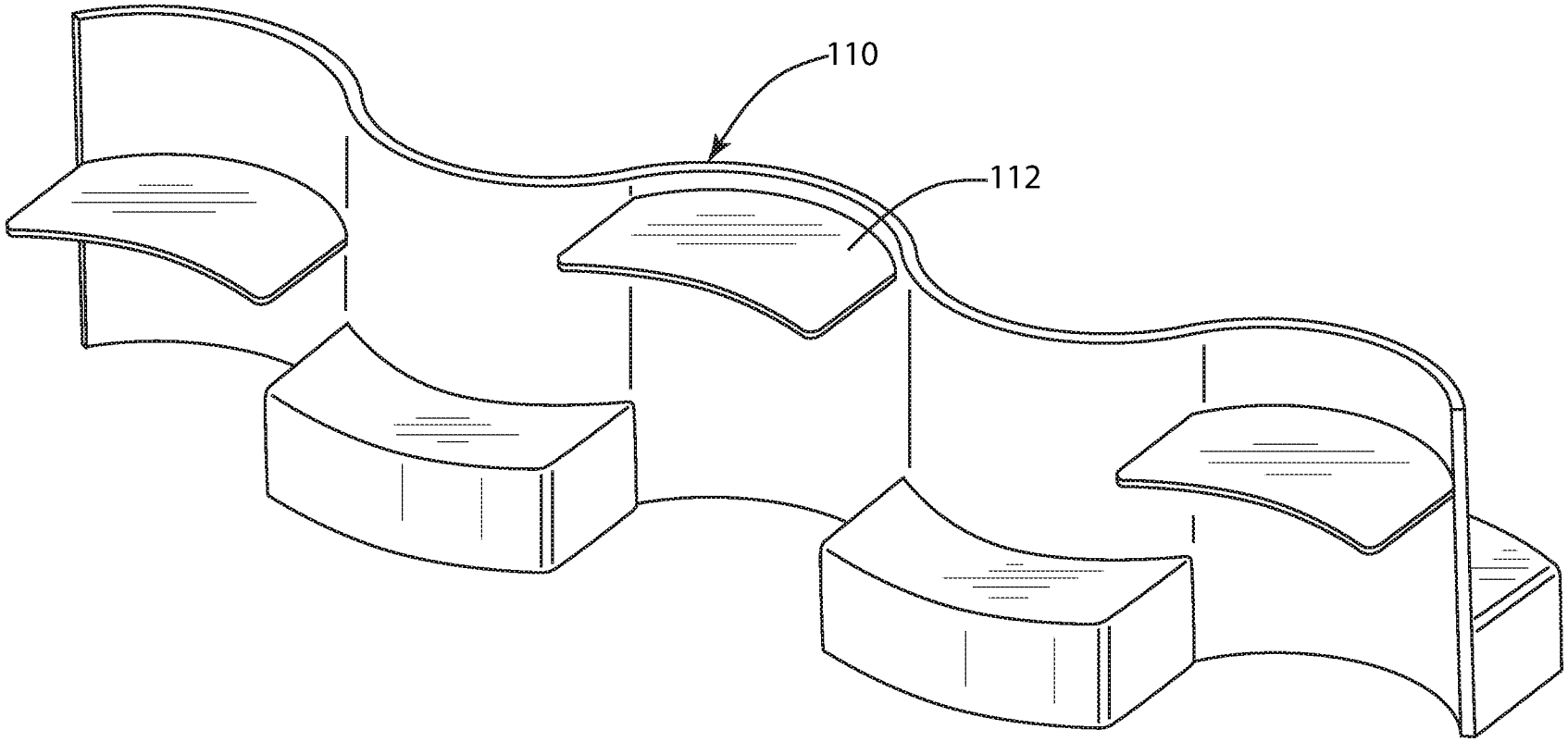
FIG. 12 is a perspective view of the invention with curved work platforms mounted on curved panels.

The work platform 50 has a planar upper surface 52 and is preferably rectangularly shaped as is clearly shown in FIGS. 3 and 10. When used on a curved wall 110 as shown in FIG. 12, the work platform 112 has a curved inner surface to fit the contour of the curved wall. The work platform 50 can be clipped to the brackets 40 and 44 or mounted to the platform 50 with fasteners such as screws as is well known in the art. Spring assemblies 60, each comprising a continuous force spring 62 mounted inside a spring housing 64, are secured to the bottom of cross member 22 as seen in FIG. 6. In FIG. 5, each free end 63 of the continuous force spring 62 is secured to a cylindrical mount 66 having a throughgoing cylindrical bore 67 which is mounted around a cylindrical support bar 68. The cylindrical support bar 68 is in turn mounted to end supports 69 which are secured to the upper cross member 18 as most clearly shown in FIGS. 5 and 6. The continuous force spring 62 extends through a rectangular opening 23 cut in rectangular cross member 22 as is most closely shown in FIG. 6. An alternate means of securing the free end 63 of the spring 62 is shown in FIG. 9. In FIG. 9, the end of 63 of the continuous force spring 62 is secured to an eyelet 65 secured to the upper cross bar 18.

Figure 8:
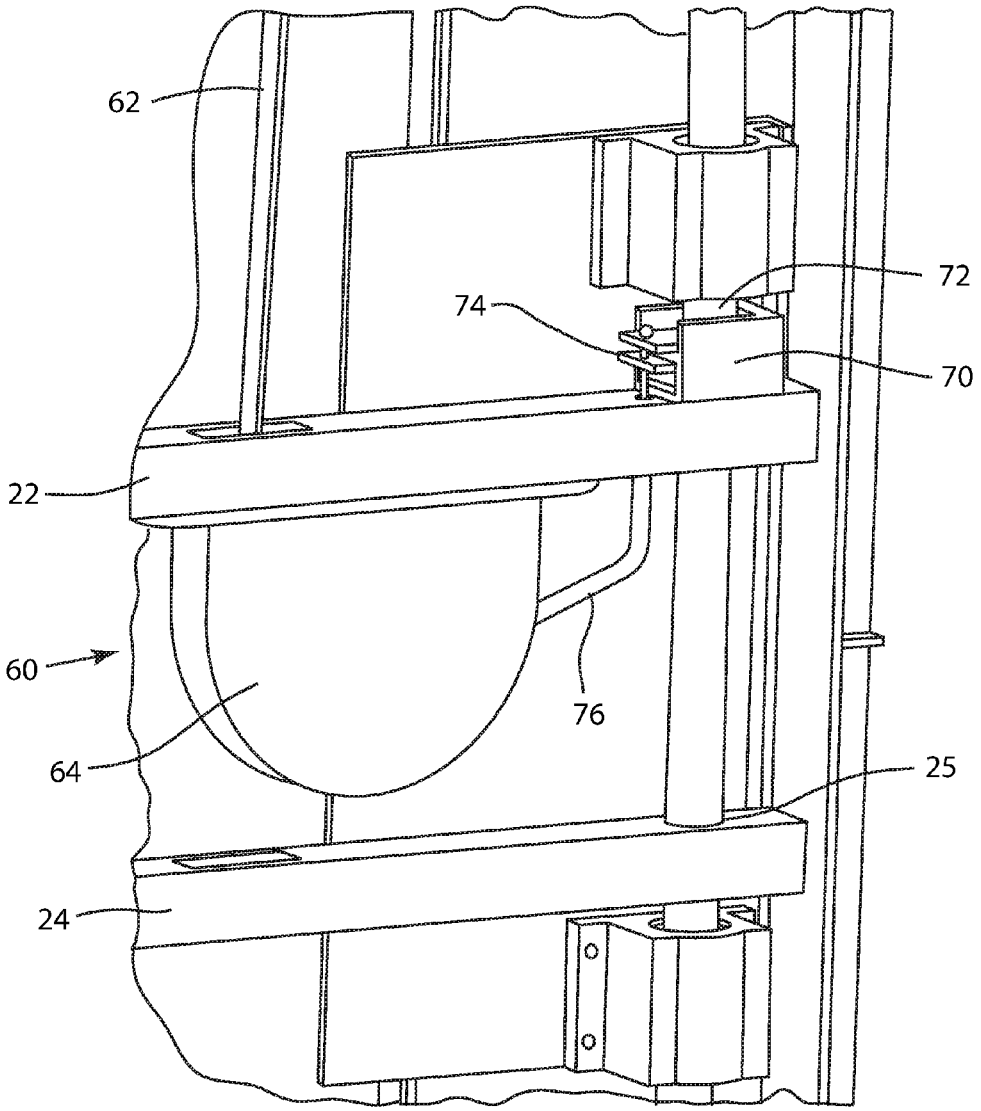
FIG. 8 is an enlarged partial view of FIG. 7.

A brake mechanism 70 as seen in FIGS. 8 and 9 comprising a spring 72 (73) and plates 74 (75) and a brake release cable 76 (77) is used to hold the work platform 50 in place.

The present wall mounted design offer work surface adjustment with the following features:

Low cost because of minimal parts

Work surface is strong and stable

Can attach to any wall or office panel

No safety issues because mechanism is covered

Adding Energy to Lift Work Surface

The ideal surface with adjustable height requires minimal force for the user to lift the work platform surface 52 to a new position. This is accomplished by using mechanical springs, to lift the weight of the work platform plus any working load.

In the wall mounted embodiment shown in FIG. 10, the continuous force springs connected to the stationary top rail 68 of the frame will exert a force to pull the work platform 50 up.

Stopping the Work Surface at any Position

As the work surface height is adjusted a brake 70 is needed to hold the work platform surface 52 in the desired position.

The brake 70 works well when the work surface load is counter balanced by the continuous force spring assembly. While, two different brake assemblies have been described, there are countless manual brake designs ranging from simple pin-in-a-hole designs, rack and pinion, gears and brake pad designs. The mechanical brake can be located at any point that prevents the linkage from moving.

Figure 11:
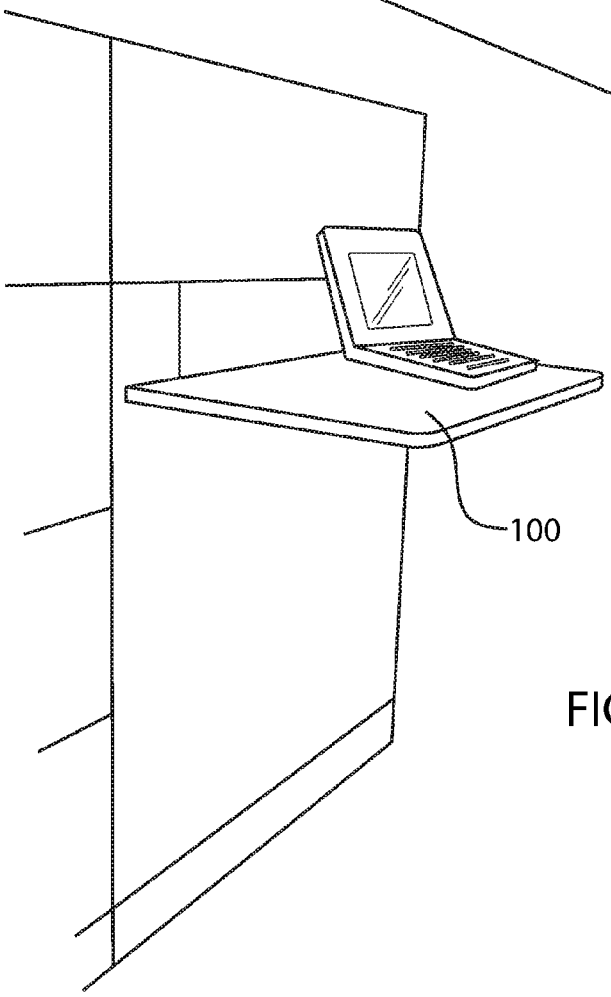
FIG. 11 is a perspective view of the invention mounted to a panel of a modular office cubical.

As seen in FIG. 10, the invention can be used as a simple wall mount 90 while FIG. 11 shows use of the invention 100 in a cubicle. FIG. 12 shows use of the invention 110 with a curved work platform 112 on curved panels.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What we claim is:

1. A work platform height adjustment apparatus comprising a frame, a support assembly moveably mounted on said frame, spring means mounted to said moveable support assembly and connected to said frame, said spring means comprising a plurality of continuous force spring assemblies, a plurality of support plates secured to said support assembly, brackets secured to said support plates, and a work platform mounted to said brackets.

2. A work platform height adjustment apparatus as claimed in claim 1 wherein each continuous force spring assembly comprises at least one spring housing, a single strip spring mounted and spring loaded in said spring housing with a free end of said strip spring extending outside said housing, said free end of said strip spring being secured to said frame.

3. A work platform height adjustment apparatus as claimed in claim 1 wherein said support assembly comprises parallel rods mounted to said frame and a plurality of cross supports moveably mounted on said parallel rods, said support plates are secured to said cross supports and at least one of said brackets is secured to each support plate.

4. A work platform height adjustment apparatus as claimed in claim 3 wherein said support plates include a plurality of linear bearings mounted thereto and each parallel rod is seated in a linear bearing.

5. A work platform height adjustment apparatus as claimed in claim 1 wherein said work platform is rectangular with a planar surface.

6. A work platform height adjustment apparatus as claimed in claim 1 wherein said work platform has a curved configuration with a planar surface.

7. A work platform height adjustment apparatus as claimed in claim 1 wherein said work platform apparatus is wall mounted.

8. A work platform height adjustment apparatus as claimed in claim 1 wherein a plurality of panels are fastened to a front surface of said frame defining at least two parallel spaces between said panels with said brackets extending outward from said support assembly through said parallel spaces.

9. A work platform height adjustment apparatus as claimed in claim 1 including an energy supply apparatus mounted to said support assembly adapted to provide lift to the work platform surface.

10. A work platform height adjustment apparatus comprising a frame, a plurality of slide rods mounted to said frame, a support assembly comprising at least one cross member moveably mounted on said slide rods, spring means mounted to said support assembly and connected to said frame, a plurality of support plates secured to said support assembly, at least one bracket secured to said support plates, a work platform mounted to said at least one bracket, and at least one panel mounted to said frame.

11. A work platform height adjustment apparatus as claimed in claim 10 wherein said support assembly comprises a plurality of cross bars slidably mounted on said slide rods and said support plates are provided with linear bearings secured thereto which are slidably mounted to said slide rods.

12. A work platform height adjustment apparatus as claimed in claim 10 wherein a plurality of panels are fastened to a front surface of said frame defining at least two parallel spaces between said panels with said brackets extending outward from said support assembly through said spaces.

13. A work platform height adjustment apparatus as claimed in claim 10 wherein said spring means is a plurality of continuous force spring assemblies.

14. A work platform height adjustment apparatus as claimed in claim 13 wherein each spring assembly is mounted on a cross member and comprises a housing, a spring mounted in said housing and a free end extending from said housing connected to said frame.

15. A work platform height adjustment apparatus as claimed in claim 10 including brake means mounted to said support assembly to lock said support assembly in a fixed position.

16. A work platform height adjustment apparatus comprising a frame, a plurality of slide rods mounted to said frame, a support assembly moveably mounted on said slide rods, spring means mounted to said support assembly and connected to said frame, said spring means comprising a plurality of continuous force spring assemblies, a plurality of support plates secured to said support assembly and carried by said support assembly, a plurality of brackets secured to said support plates extending outward from said frame, a work platform mounted to said brackets, said work platform being provided with a planar surface and at least one cover panel mounted to said frame to form an enclosed frame housing.

17. A work platform height adjustment apparatus as claimed in claim 16 wherein said at least one cover panel are a plurality of panels forming two side panels and a middle panel.

18. A work platform height adjustment apparatus as claimed in claim 17 wherein said plurality of panels are fastened to a front surface of said frame defining at least two parallel spaces between said panels with said brackets extending outward from said support assembly through said spaces.

19. A work platform height adjustment apparatus as claimed in claim 16 wherein bearing assemblies are mounted to said support plates, said bearing assemblies comprising a housing, bearings mounted in said housing, said housing defining a throughgoing central bore having a diameter greater than said slide rods.

* * * * *